United States Patent [19]

Palau

[11] 4,351,368

[45] Sep. 28, 1982

[54] DOBBY

[75] Inventor: Joseph Palau, Duingt, France

[73] Assignee: S.A. des Etablissements Staubli, Fauerges, France

[21] Appl. No.: 153,794

[22] Filed: May 28, 1980

[30] Foreign Application Priority Data

Jun. 22, 1979 [FR] France ..... 79 16669

[51] Int. Cl.[3] ..... D03D 51/00

[52] U.S. Cl. ..... 139/324; 139/329

[58] Field of Search ..... 139/1 E, 71, 72, 324, 139/329, 333; 66/231, 238, 239

[56] References Cited

U.S. PATENT DOCUMENTS 4,150,698 4/1979 Griffith ..... 139/329

4,250,930 2/1981 Palau et al. ..... 139/324

*Primary Examiner*—Henry Jaudon

*Attorney, Agent, or Firm*—Dowell & Dowell

[57] ABSTRACT

The invention relates to dobbies of the type with double swinging levers and fastening hooks, provided with an auxiliary actuating system ensuring functioning for a weave different from that corresponding to the conventional reading device. To this end, a cam is provided, of such section that, by an angular displacement imparted after the momentary retraction of the disc of the reading device, the heel provided on certain of the hooks is pushed, causing said latter to pivot. The invention finds particular application in the textile industry.

3 Claims, 3 Drawing Figures

DOBBY

The present invention relates to dobbies for forming the shed on weaving looms and more particularly, among these mechanisms, to those in which each heddle frame is coupled by a suspension lever to a double swinging lever subjected to the action of two oscillating bars or crosspieces, which lever is provided at its ends with noses cooperating with articulated fastening hooks, themselves controlled by a reading device as a function of the design or weave to be made on the fabric.

It is known that, in practice, it is sometimes necessary, to make an intervention on the loom, to interrupt the weaving process according to the programme introduced into the dobby and momentarily to actuate the heddle frames in a different weave, for example a very simple weave of the taffeta type. This is particularly the case when lease rods are to be placed in position, adapted for the operations of connection between two consecutive warp yarn sheets.

Whatever the nature of the operation to be carried out, a specialized mechanic must be called upon in such circumstances, who will dismantle and re-assemble the interior members of the dobby to assure the desired control at heddle frame level. Although this control lasts only a very short time, the functioning of the loom is stopped for a particularly long time due to the complexity of the work carried out on the dobby.

With a view to remedying this drawback, the present invention proposes to provide the dobbies with an auxiliary control system arranged so as automatically to actuate, after momentary retraction of the reading device, the fastening hooks of the double swinging levers in a weave different from the one imparted to the dobby by this reading device.

The invention consists essentially in providing the dobby with a cam oriented parallel to the pivot pin of the articulated fastening hooks and adapted to actuate, by a suitable angular displacement, a heel provided on certain of said hooks, this actuation causing the appearance of a particular weave at the level of the double swinging levers associated with the heddle frames.

It will be understood that the angular displacement of the cam may be obtained with the aid of a manoeuvring member coupled to the support of the reading device so that the momentary retraction thereof and its return to the state of functioning are effected at the same time as the control of the auxiliary system.

Figure 1:
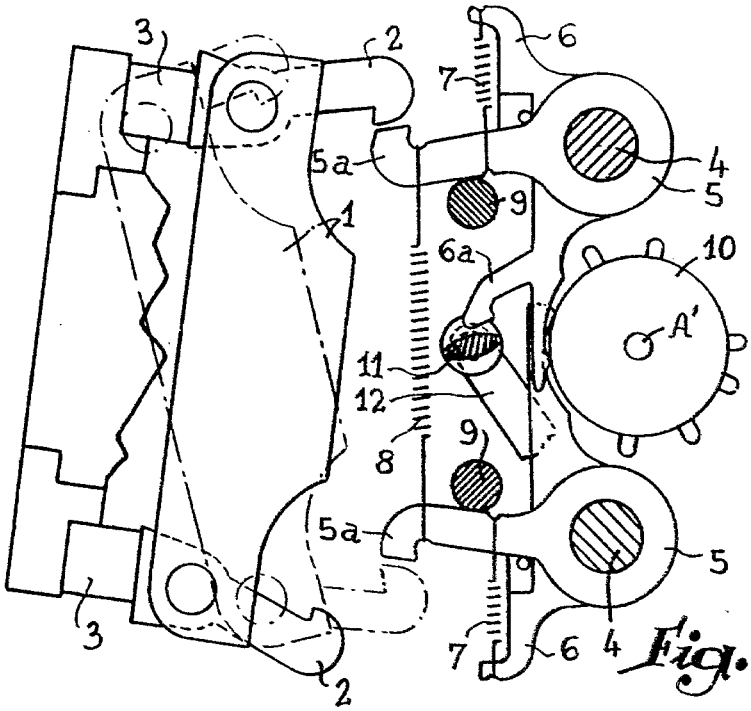

The invention will be more readily understood on reading the following description with reference to the accompanying drawings, in which:

FIG. 1 is a vertical section schematically illustrating the two modes of actuation of the fastening hooks associated with one of the double-swinging levers of a dobby according to the invention.

Figure 2:
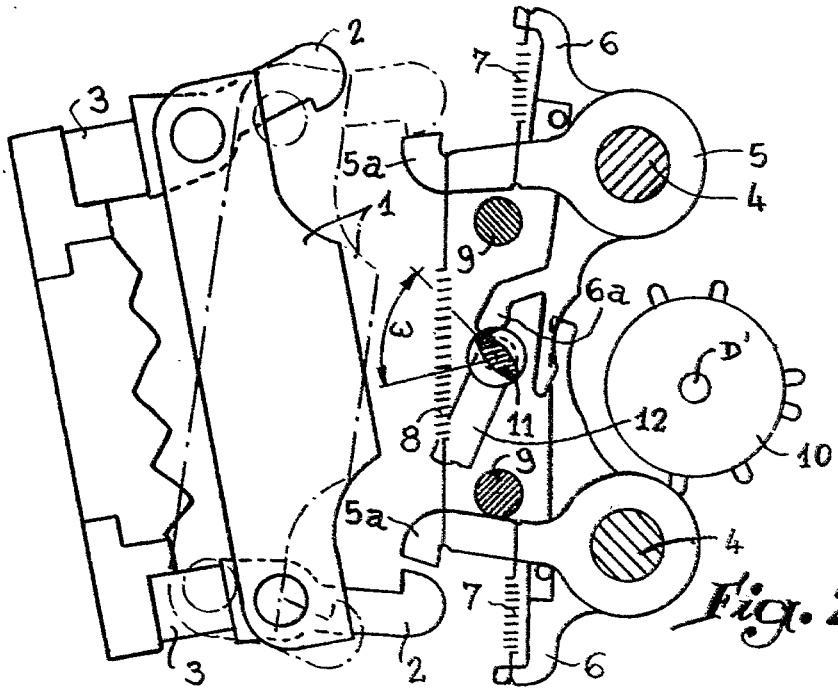

FIG. 2 reproduces FIG. 1 after retraction of the reading device and setting of the auxiliary control system into state of operation.

Figure 3:
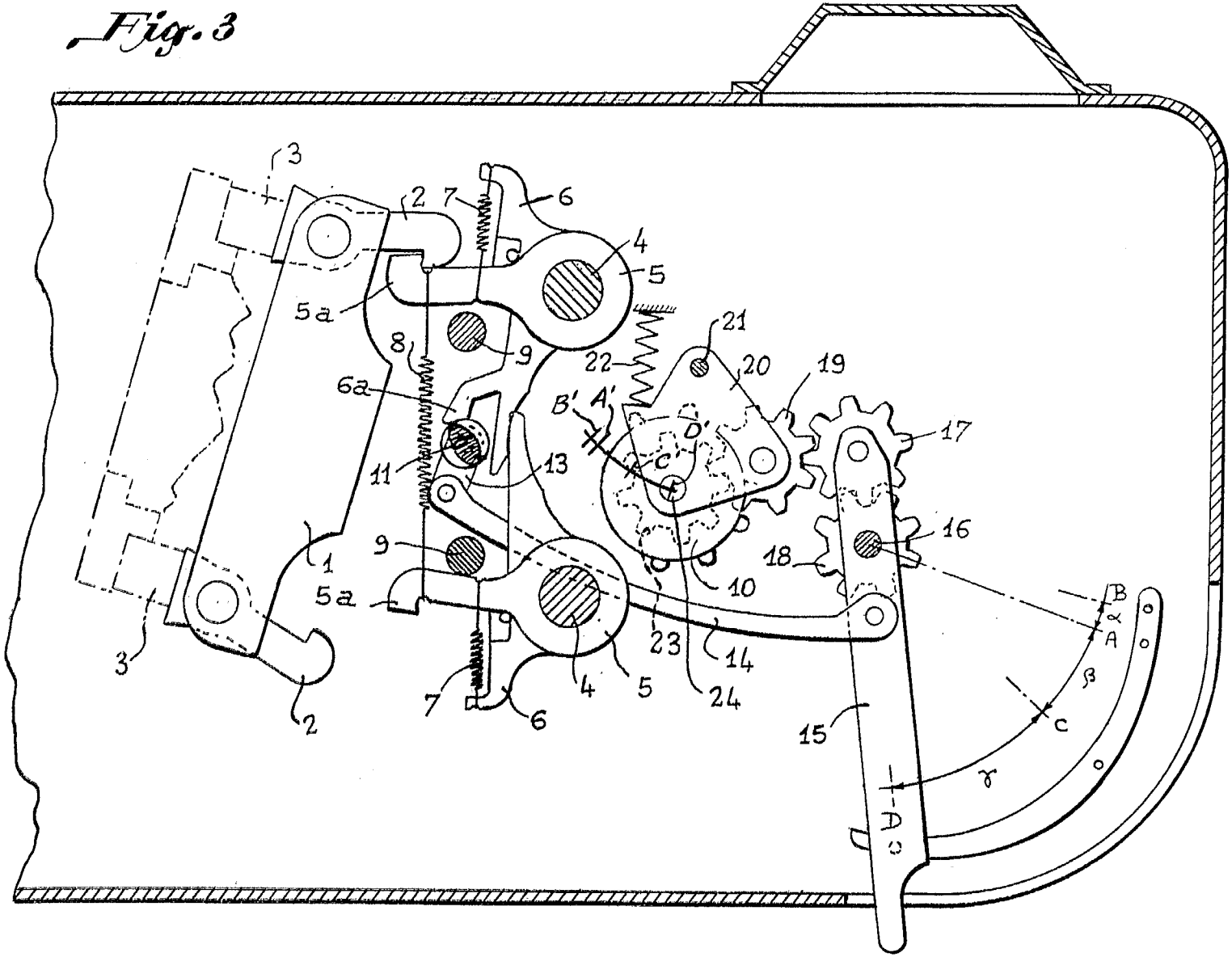

FIG. 3 shows a preferred embodiment of the dobby according to the invention.

Referring now to the drawings, reference 1 in FIG. 1 designates each of the ends of one of the conventional double-swinging levers of the dobby. Each end 1 is provided with a nose 2 adapted to cooperate, under the effect of the reciprocating actuation bars schematized in the form of arrow 3, with the corresponding nose of a fastening hook pivotally mounted on a fixed horizontal pivot pin 4.

It will be noted that each of the two fastening hooks is advantageously made in the manner described in French Pat. No. 1 503 816 filed on Oct. 7, 1966 in the name of GEBR. STAUBLI & Co. for "Improvements in double-lift dobbies" and consequently comprises two elements 5 and 6 mounted side by side on the pivot pin 4 and connected to each other by a stop system and by a spring 7. The two elements of the hooks 5–6 are connected by a vertical spring 8 which tends to maintain the element 5 of each of them in contact with a fixed bearing surface 9. It should be noted that all of the upper and lower hooks are free to turn independently about the pivots 4.

Between the hooks 5–6 is mounted the rotating disc of the reading device, shown schematically at 10. This disc 10 conventionally comprises a series of radially projecting pegs disposed on its periphery as a function of the design to be made on the fabric. As the disc 10 rotates, the radial pegs selectively push the element 6 of certain of the articulated hooks 5–6, so that the hooks thus controlled pivot about the pivot pins 4 and the nose 5*a* of their element 5 comes into position in the path of the corresponding nose 2 of the double swinging lever 1 envisaged.

In accordance with the invention, there is provided, substantially between the fixed step bearing surfaces 9 of the hooks 5–6, a horizontal rod 11 oriented parallel to the pivot pins 4 of said hooks. As shown, this rod 11 is substantially elliptic in cross section, so as to form an actuating cam, as will be more readily understood hereinafter. Furthermore, the element 6 of certain of the hooks 5–6 is provided with a lateral heel 6*a* shaped so that its free end is disposed in the immediate vicinity of the rod or cam 11 indicated hereinabove. It should be noted that, in the example shown, the arrangement of the heel 6*a* on the upper element 6 can be reversed and applied to a lower hook element to operate a different double swinging lever 1 of the dobby. For a simple alternating shed pattern, for the lever 1 shown, this heel is provided on the upper hook 5–6, then for the two levers mounted on either side of the one shown, a similar heel 6*a* will be integral with the element 6 of the adjacent lower hook 5–6, and so on for all the double swinging levers of the mechanism.

The functioning of the dobby will be readily understood. When the rod or cam 11 is oriented as shown in FIG. 1, i.e. with the large axis of its transverse section disposed horizontally, it does not contact the heels 6*a*, so that the functioning is identical to that of a conventional dobby of the type with double swinging levers and articulated fastening hooks; the hooks 5–6 pivot according to the design provided on the rotating disc 10 of the reading device, accordingly actuating the double swinging levers 1 and the heddle frame associated with each of them.

On the other hand, when it is desired to make an intervention at loom level, for example to position lease rods intended for connecting two warp yarn sheets, the disc 10 of the reading device is momentarily retracted (FIG. 2) by displacing it so that, whilst continuing to be rotated, said disc no longer actuates the elements 6 of the hooks 5–6 by its pegs; the hooks therefore remain immobile, in abutment against the fixed bearing surfaces 9. Furthermore, the rod or cam 11 is pivoted, for example with the aid of a manoeuvring lever 12 fixed at one of its ends, through an angle $\omega$, so as to shift the large axis of its transverse cam section to a substantially vertical orientation. At the end of its angular displacement, this rod or cam 11 pushes the heels 6a which then cause the hooks 5–6 with which they are integral, to pivot; the nose 5a of the hooks thus selected comes into position on the path of the corresponding noses 2 of the double swinging levers which continue to be actuated by the bars or crosspieces 3, so that the desired taffeta weave is obtained by positioning the lease rods.

At the end of the intervention on the loom by the operator, suffices to return the rod or cam 11 to the initial orientation as shown in FIG. 1 and to return the rotating disc 10 of the pattern reading device into position of normal functioning against the ends of the hook elements 6, so that the loom can continue to weave in the manner for which it was set up.

It will be noted that the invention finds a particularly advantageous application in combination with the reading devices of the type such as those forming the subject matter of U.S. Pat. No. 4,250,930, issued on Feb. 17, 1981 in the name of Applicants. Such a combination is shown schematically in FIG. 3 of this disclosure.

In this embodiment, the rod or cam 11 is connected with a radial lever 13 connected by a connecting rod 14 to a common manoeuvring member formed by an arm 15. The latter pivots freely on the drive shaft 16 of the reading device and it extends radially beyond said shaft 16 to bear, at its end, a gear 17 which meshes simultaneously with an input gear 18 fixed to the said drive shaft 16 and with an intermediate gear 19, which is borne by an actuating lever 20. The lever 20 pivots at 21 and is urged counterclockwise by the action of a spring 22 which tends to maintain gears 19 and 17 in mesh whatever the orientation of the manoeuvring arm 15. The gear 19 drives an output gear 23 fixed on the shaft 24 which carries the pegged disc 10 of the reading device, said shaft 24 being, of course, mounted on the actuating lever 20. This structure resembles that of our U.S. Pat. No. 4,250,930.

When the weaving loom functions normally, the manoeuvring arm 15 is disposed in the orientation indicated by the dashed line at A; consequently, the shaft 24 of the pegged pattern disc 10 is in position A′ with the result that said disc actuates the hooks 5–6 associated with the double swinging levers 1 of the dobby, the rod or cam 11 being oriented as in FIG. 1 in order not to hinder this actuation.

As described in the above-mentioned U.S. Pat. No. 4,250,930, the arm 15 may be displaced through an angle $\alpha$ to be brought to B when it is desired to obtain reverse motion for unweaving, without affecting the dobby-loom synchronisation; the very slight modification in orientation of the arm 15 transmitted to the lever 13 by the connecting rod 14 has no practical effect on the orientation of the rod or cam 11 which can therefore not reach the heels 6a. The shaft 24 will occupy the position B′.

In the same way, from the position A of normal functioning, the arm may be displaced through an angle $\beta$ to bring it into position C with a view to retracting the disc 10 by a withdrawing movement. The hooks 5–6 are no longer actuated and the heddle frames all take the low position corresponding to the levelling of the needles. There again, the amplitude of the angular displacement transmitted by the connecting rod 14 to the rod or cam 11 is not enough substantially to modify the orientation of the cam 11 which consequently remains inoperative with respect to the heels 6a. The shaft 24 will occupy position C′ in which the pegs of the disc 10 are entirely out of contact with the elements 6.

However, when the operator wishes to make an intervention in the functioning of the loom, either for positioning lease rods or for obtaining a taffeta or other simple weave, he displaces the arm 15 from this levelling position C for which the disc 10 is retracted with respect to the fastening hooks 5–6, through an angle $\gamma$ to bring it to position D, the rod or cam 11 is then at such an angular orientation that the heels 6a are pushed and the corresponding hooks are actuated, as in the case of FIG. 2 and as shown in FIG. 3. The shaft 24 is then in position D′, and the loom then operates to make a taffeta weave; of course, it suffices to return the arm 15 to position A to return the loom and the dobby into position of normal functioning with the shaft 24 of the pattern disc 10 in position A′.

Finally, it will be appreciated that the manoeuvre of the single arm 15 makes it possible to obtain the four types of functioning desired, without necessitating any dismantling operation. Suitable arcuate detent means can be provided, as shown in U.S. Pat. No. 4,250,930, to retain the arm 15 selectively in any one of the positions A,B,C or D. It is obvious that the heels 6a may be provided on the hooks 5–6 so that any simple weave is obtained, the taffeta weave having been mentioned hereinabove only by way of illustration.

Various modifications may of course be made by the man skilled in the art to the apparatus which has just been described solely by way of non-limiting example, without departing from the scope of the invention.

What is claimed is:

1. An improved reading device for a loom dobby having a housing containing double swinging levers, and having hooks pivotable about fixed pivot bars, and having rotating pattern discs with pegs extending therefrom to contact adjacent elements of the hooks and displace the contacted hooks into engagement with the pivot bars, and having a drive shaft for driving the pattern discs, the improvements comprising:

actuating lever means supporting said discs for rotation about a support shaft, the lever means being carried by the dobby housing and moveable to move the discs and supporting shafts between operative positions wherein the pegs engage the hook elements, and retracted inoperative positions;

a transverse cam member rotatably mounted in the housing and extending across the hook elements parallel to their pivot bars;

heel members mounted on some of the hook elements and extending toward the cam member, the cam member being pivotable between a position in which it engages the heel members and displaces the associated hooks to engage the pivot bars, and inoperative positions out of engagement with the heel members; and arm and connecting rod means connected to rotate the cam member and to displace the actuating lever means between selectible different arm positions in which the cam member and discs are both in inoperative positions, in which the lever means moves the discs into said operative position and the cam member into an inoperative position, and in which the cam member is in heel-member engaging position and the lever means and discs are in inoperative position.

2. The reading device as claimed in claim 1, wherein the cam member comprises an elongated bar of elliptical cross-section.

3. The reading device as claimed in claim 1, wherein said arm is pivotally mounted on said dobby drive shaft which supports an input gear, and wherein said arm can be selectively pivoted toward and away from said hooks and carries gear means engaged with gear means driving said disc supporting shaft, the gear means and actuating lever rocking relative to said housing to displace said discs toward and away from the hook elements, the transverse cam member having a lever extending therefrom and coupled to the arm by said connecting rod means, whereby rocking of the arm simultaneously rocks the discs toward and away from the hook elements, and rotates the cam member out of and into contact with the heel members.

* * * * *